US008555588B2

(12) United States Patent
Stokes

(10) Patent No.: US 8,555,588 B2
(45) Date of Patent: Oct. 15, 2013

(54) INSULATING CONCRETE FORM SYSTEM WITH FIRE-BREAK TIES

(76) Inventor: Jonathan D. Stokes, Kansas City, MO (US)

( * ) Notice: Subject to any disclaimer, the term of this patent is extended or adjusted under 35 U.S.C. 154(b) by 2181 days.

(21) Appl. No.: 11/355,353

(22) Filed: Feb. 17, 2006

(65) Prior Publication Data

US 2007/0193165 A1 Aug. 23, 2007

(51) Int. Cl.

| | |
|---|---|
| ***E04C 1/00*** | (2006.01) |
| ***E04C 3/30*** | (2006.01) |
| ***E04B 1/16*** | (2006.01) |
| ***E04B 2/00*** | (2006.01) |
| ***E04B 1/02*** | (2006.01) |

(52) U.S. Cl.
USPC ..... 52/383; 52/309.11; 52/427; 52/562; 52/568

(58) Field of Classification Search
USPC ..... 52/561–566, 568, 427, 428, 587.1, 52/598–599, 378–379, 383, 513, 309.11
See application file for complete search history.

(56) References Cited

U.S. PATENT DOCUMENTS

| | | | | | |
|---|---|---|---|---|---|
| 4,698,947 | A * | 10/1987 | McKay | 52/309.12 |
| 4,765,109 | A * | 8/1988 | Boeshart | 52/426 |
| 5,566,518 | A * | 10/1996 | Martin et al. | 52/426 |
| 5,568,710 | A * | 10/1996 | Smith et al. | 52/426 |
| 5,570,550 | A * | 11/1996 | Roby | 52/309.12 |
| 5,735,093 | A * | 4/1998 | Grutsch | 52/309.11 |
| 5,845,449 | A * | 12/1998 | Vaughan et al. | 52/565 |
| 6,178,711 | B1 * | 1/2001 | Laird et al. | 52/427 |
| 6,240,692 | B1 * | 6/2001 | Yost et al. | 52/426 |
| 6,349,520 | B2 * | 2/2002 | Kubica | 52/426 |
| 6,401,419 | B1 * | 6/2002 | Beliveau | 52/592.6 |
| 6,665,992 | B2 * | 12/2003 | Hew | 52/562 |
| 6,792,729 | B2 * | 9/2004 | Beliveau | 52/426 |
| 6,820,384 | B1 * | 11/2004 | Pfeiffer | 52/426 |
| 7,082,731 | B2 * | 8/2006 | Patz et al. | 52/426 |
| 2002/0017070 | A1 * | 2/2002 | Batch | 52/309.11 |
| 2002/0026761 | A1 * | 3/2002 | Moore, Jr. | 52/309.11 |
| 2004/0040240 | A1 * | 3/2004 | Patz et al. | 52/309.11 |
| 2005/0223669 | A1 * | 10/2005 | Cymbala et al. | 52/426 |
| 2006/0117690 | A1 * | 6/2006 | Garrett | 52/309.11 |
| 2007/0175155 | A1 * | 8/2007 | Cymbala et al. | 52/562 |
| 2007/0294970 | A1 * | 12/2007 | Marshall et al. | 52/309.11 |

* cited by examiner

*Primary Examiner* — Ryan Kwiecinski
(74) *Attorney, Agent, or Firm* — Richard L Huff

(57) ABSTRACT

An insulating concrete form foam block bi-directional system comprises a pair of opposed and parallel foam sidewall panels spaced using a plurality of plastic and metal band ties that act as a fire-break between the two exterior finished concrete wall surfaces. Each tie comprises nearly full sidewall height, plastic flanges which engage the sidewalls and a metal band cross-connecting vertical holders of the ties. The metal band forms a wide opening to enhance concrete flow. The tie results in a minimal downward stress impact on the tie during concrete placement. The top and bottom surfaces of each sidewall are formed with raised areas and non-raised areas which interlock with adjacent blocks. The side surfaces of each sidewall are formed with vertical tongues and grooves which interlock with like tongues and grooves of corner pieces which are adapted to form right or left-hand corners.

5 Claims, 20 Drawing Sheets

Fig. 31
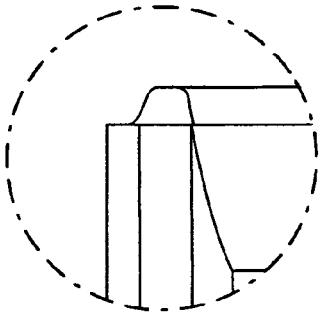
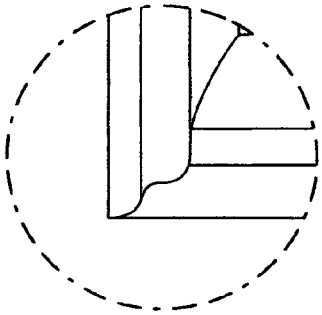
Fig. 32
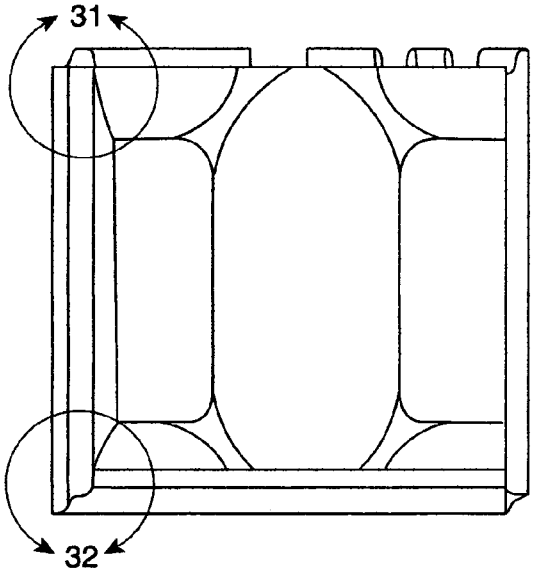
Fig. 30

INSULATING CONCRETE FORM SYSTEM WITH FIRE-BREAK TIES

CROSS-REFERENCE TO RELATED APPLICATIONS (Not applicable)

STATEMENT REGARDING FEDERALLY SPONSORED RESEARCH OR DEVELOPMENT (Not applicable)

REFERENCE TO SEQUENTIAL LISTING, A TABLE, OR A COMPUTER PROGRAM LISTING APPENDIX SUBMITTED ON A COMPACT DISC (Not applicable)

BACKGROUND OF THE INVENTION

1. Field of the Invention

The present invention relates to concrete construction utilizing foam block forms, more specifically to improvements to the foam sidewalls used to create a longitudinally bi-directional system, improved form sidewall spacing ties which create enhanced concrete flow, enhanced strength, and enhanced fire-break properties, and a corner form that can be used as a right-hand or left-hand form.

2. Description of the Related Art

Concrete forms made of a polymeric foam material are known. Such forms basically comprise a pair of laterally spaced-apart sidewalls presenting a cavity therebetween. A number of these forms are connected to present longitudinally and vertically aligned cavities for pouring concrete therein.

One such form is shown in U.S. Pat. No. 3,788,020, issued on Jan. 29, 1974. This patent discloses a concrete form with a pair of sidewalls, end walls and intermediate partition walls. A plurality of these forms are connected to present vertical cavities for pouring concrete therein to form a plurality of vertical concrete columns or piers. These vertical columns are connected by a horizontal concrete beam formed by filling a channel with concrete, the channel presented upon placing one row of concrete forms atop another.

One problem with existing concrete forms is that the sidewalls must be immobilized so as to resist pressures on the walls during transport and, more importantly, during concrete pouring and curing. If not, the form sidewalls may shift in lateral and/or vertical and/or longitudinal directions. Such displacements make it difficult to easily connect the forms. Also, the forms may separate along the joints respectively presented along the zones of connection between longitudinally and vertically adjacent forms. If the forms are not sufficiently braced, the concrete can cause these joints to separate. The industry refers to such separations as "blow outs".

During the pouring of the concrete, a hydraulic concrete load acts on the sidewalls of each form as well as on any structure spanning such sidewalls. The load urges the sidewalls from their proper vertical, lateral and longitudinal spatial relationships. Also, during form transport to the job site, the sidewalls may be displaced due to the weight of other forms stacked thereon. In some cases the distance between the sidewalls may vary. Accordingly, problems will arise when attempting to longitudinally and vertically connect forms as the mating lap joint surfaces and/or tongue/groove elements will not be properly aligned.

The closest related publications known to the inventor are U.S. Pat. No. 4,223,501 granted to DeLozier Sep. 23, 1980 and Published U.S. Application 2004/0045237 invented by Coombs et al and published Mar. 11, 2004. Each of these publications shows concrete forms made of opposing panels. The panels are held in spaced relationship by ties. In the patent publication, the tie contains inadequate open space to allow for the free flow of concrete necessary during a pouring operation in order to avoid air pockets which will weaken the resulting wall. In both of these publications, the tie is a single piece bent at each side to form an anchor. This allows for lateral movement during shipping and a corresponding loss of alignment. When this happens the units do not fit together properly on the construction site.

Also, in both of these publications, the tie is made of metal, which conducts heat and can be a mode of transmitting heat during fire. Additionally, in both of these publications there is no predetermined space for connecting the form to studs.

As seen from the above, various devices in the forms of braces and permanent tension members have been proposed so as to maintain the sidewalls in place to preclude such shifting and/or "blow outs" during concrete pouring and subsequent curing. However, such devices have been relatively complex in construction requiring the sidewalls to have special configurations so as to receive the braces and/or ties and have lacked desirable features.

In prior art systems, corners present some problems. Typically a wall form is extended to the end of the wall and a piece of foam plastic is secured over the end of the wall form by wire or the like.

This type of end is difficult to secure to the wall form, frequently breaks during concrete pouring, and is not securely fastened to the wall form. This creates unnecessary labor in fixing breaks, setting up the forms, and affixing exterior sheathing to the corner of the wall.

In another prior art approach, the specific corner form is provided, but it is preformed for a certain specific job and must be either a right-hand corner or a left-hand corner. Right-hand or left-hand orientation is always determined from a top plan view because these forms have by necessity a top end and a bottom end. Therefore, a right-hand corner form cannot be substituted for a left-hand corner and visa versa. This doubles the number of types of molds required to produce the corner forms, doubles the types of corner forms needed in inventory, increases delivery costs, and so forth.

Therefore, there is a need for a corner form for a concrete wall that is universal, that is, can be used for either a right-hand or left-hand wall corner; that can be securely and easily attached to the wall form; that does not break during concrete pouring; and that is securely fastened to the wall form.

BRIEF SUMMARY OF THE INVENTION

The present invention is directed to maintaining the positive aspects of the advances already made by the prior art while eliminating the problem areas. Thus, the inventor has invented improvements in concrete forms.

A particular object of this invention is to provide a concrete form bi-directional system which enhances on-site assembly of the concrete form walls. This improvement takes the form of a bi-directional insulating concrete form system having novel upper, lower, and side surfaces that provide one-hundred eighty degree rotation of the form creating a bi-directional orientation for corresponding insulating concrete forms. Forty-five and ninety degree corner blocks are also part of this invention.

One improvement disclosed in this invention is a corner form for a concrete wall. This form creates a universal corner form, that is, it can be used to create right-hand or left-hand wall corners in concrete walls. Another feature of this corner form is that it can be securely and easily attached to the wall form. Another feature of this corner form is that it can provide a corner form for a concrete wall that does not break during concrete pouring. This corner form for a concrete wall is securely fastened to the wall form.

Another improvement over the prior art is a form tie, more particularly, novel form ties for maintaining the sidewalls of a concrete form in desired longitudinal, vertical and laterally spaced-apart relationships that also serve as a fire-break. Each form tie generally comprises a pair of plastic vertical side pieces with a pair of metal horizontal pieces spanning the form sidewalls. The ties are formed by connecting a pair of plastic vertical side pieces with a pair of metal horizontal pieces. The horizontal pieces are located at the upper and lower ends of the vertical pieces. The vertical side pieces are embedded in the sidewalls of the forms during the molding process with the horizontal pieces spanning the facing interior surfaces of the sidewalls. The ties preclude lateral, vertical and longitudinal shifting of the sidewalls during transport and use. The ties of the present invention find use in concrete forms and effectively interface with the form sidewalls so as to maintain the walls in a desired spatial relationship during transport as well as concrete pouring and curing. The forms of the present invention also automatically present a longitudinally enhanced fire-break resulting from the innovative use of metal band horizontal pieces and thermoplastic vertical side pieces. During a fire, the thermoplastic vertical side pieces melt and do not conduct heat to the horizontal pieces. Thus, the heat stays on one side of the enclosed concrete. Also, the ties are oriented to reduce downward stress on the ties, as a whole, during the pouring of plastic concrete in the cavity formed between the sidewalls.

The ties resist loads that impart tension, compression, bending, twisting and lateral stresses acting thereon. The ties also diminish the lateral, vertical and longitudinal displacement of adjacent sidewalls of a concrete form during transport and use. The ties of the present invention further enhance on-site assembly of the concrete forms, inclusive of the installation of exterior finish materials attached thereto. These ties effectively resist the forces arising from concrete flow but without interference with the concrete flow in the cavity between the form sidewalls and between adjacent forms.

Other objects and advantages of this invention will become apparent from the following description taken in connection with the accompanying drawings, wherein is set forth by way of illustration and example, now preferred embodiments of this invention.

BRIEF DESCRIPTION OF THE DRAWINGS

FIG. 30 is an elevational side view of a corner form sidewall of this invention.

FIG. 31 is an enlarged side elevational view of the top portion of the corner form sidewall shown in FIG. 30.

FIG. 32 is an enlarged elevational side view of the bottom portion of the corner form sidewall shown in FIG. 30.

DESCRIPTION OF THE PREFERRED EMBODIMENT

Figure 1:
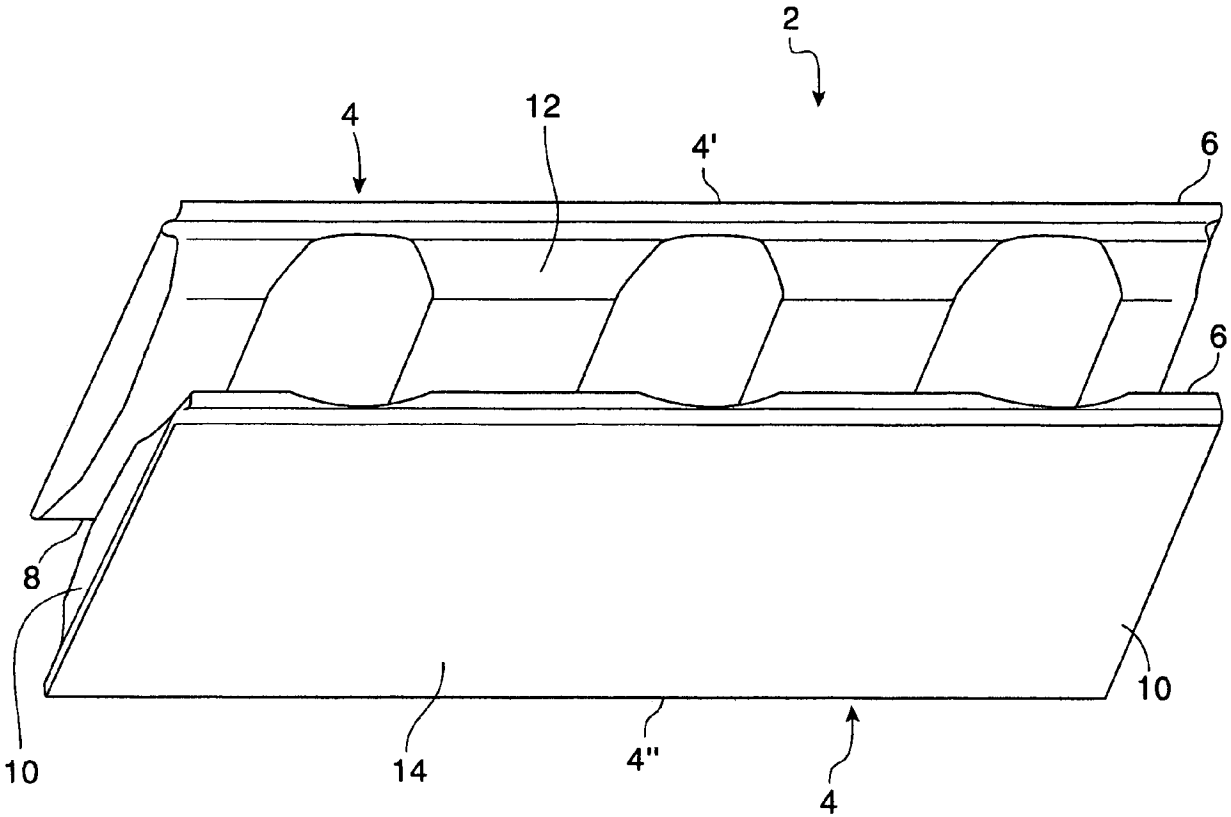
FIG. 1 is an elevational perspective view of an elongated concrete form of the present invention.

The invention will now be described with reference to the above drawings wherein like reference numerals refer to like parts throughout the description.

Turning more particularly to the drawings, FIGS. 1-14, show one type of longitudinal concrete form 2 which comprises a pair of rectangular sidewalls 4. These sidewalls 4 are preferably made of fire-resistant foamed plastic. Each sidewall 4 has upper 6 and lower 8 longitudinal surfaces as well as a pair of opposed vertical surfaces 10. Each sidewall 4 has an inner surface 12 and an outer surface 14. When the longitudinal form 2 is assembled, the inner surfaces 12 of the sidewalls 4 cooperate to form a plurality of vertical cavities 16 and a vertical slot 18. The slot 18 longitudinally spans the length of the form 2 and connects the cavities 16. The outer surface 14 is flat and serves to receive facing or studs.

Figure 2:
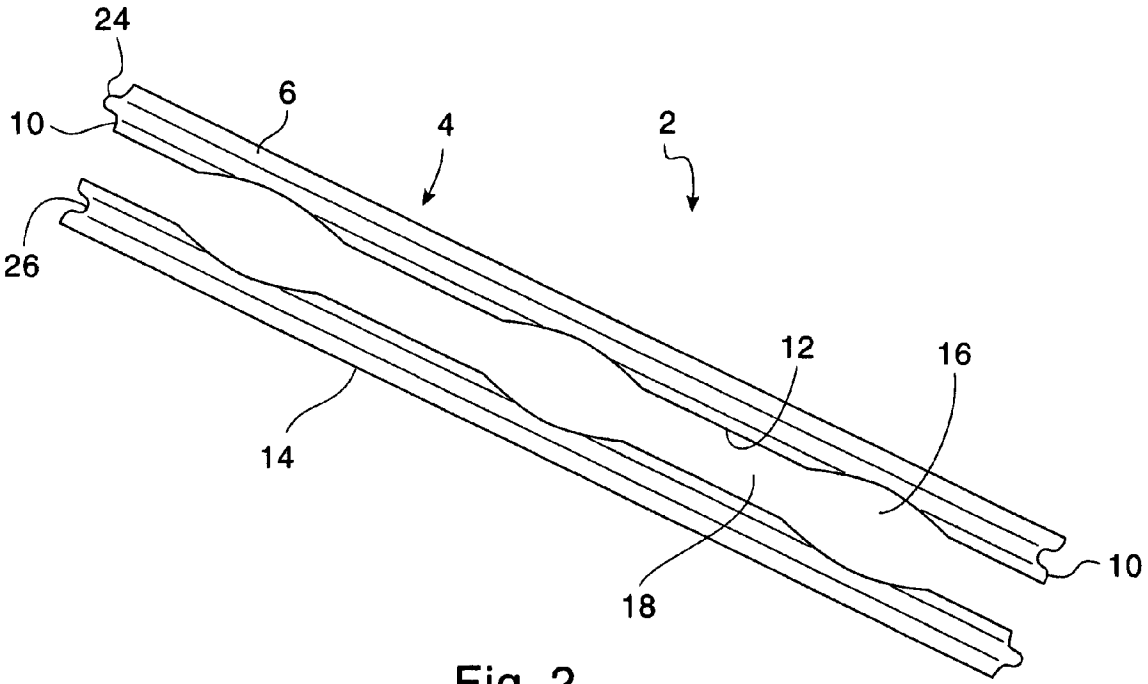
FIG. 2 is an elevational top view of the elongated form shown in FIG. 1.
Figure 3:
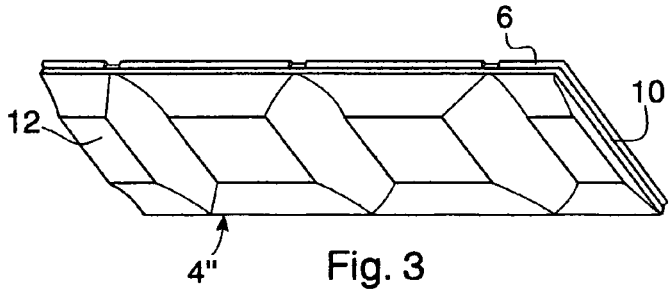
FIG. 3 is an elevational perspective view of one embodiment of an elongated form sidewall of this invention.
Figure 4:
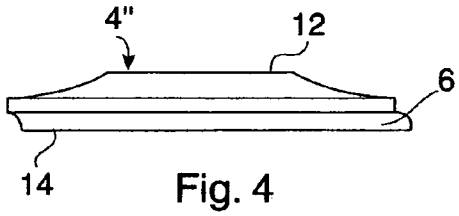
FIG. 4 is an elevational end view of the elongated form sidewall of FIG. 3.
Figure 5:
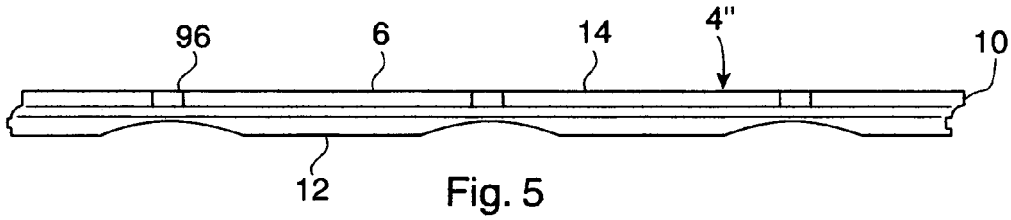
FIG. 5 is an elevational top view of the elongated form sidewall of FIG. 3.
Figure 6:
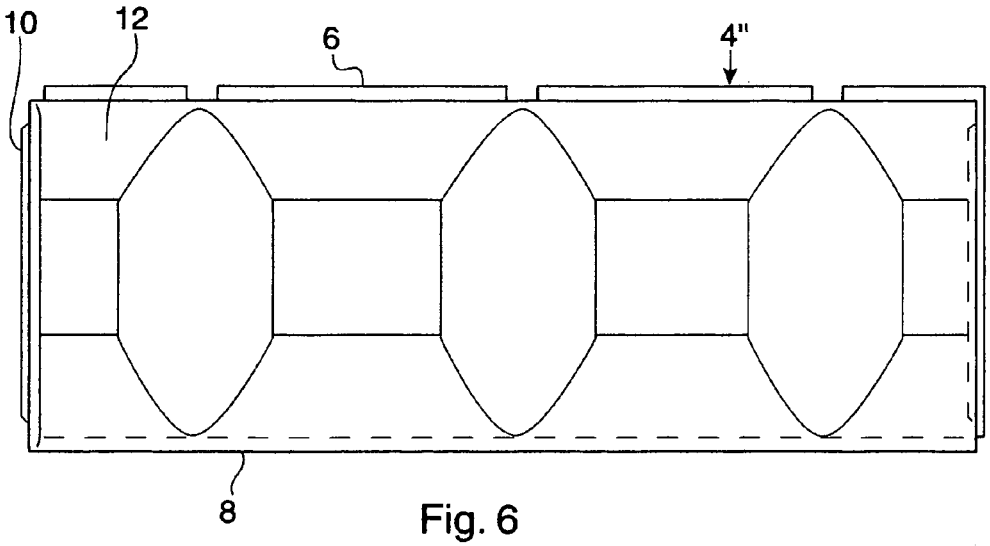
FIG. 6 is an elevational side view showing the inside of the elongated form sidewall of FIG. 3.
Figure 7:
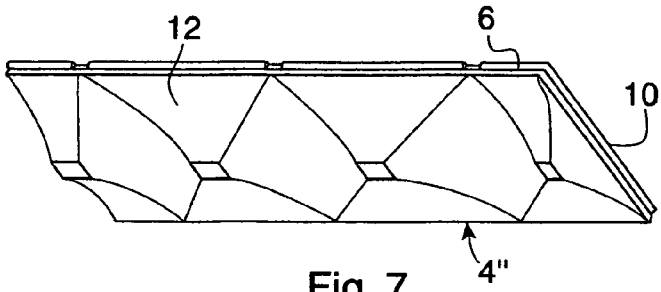
FIG. 7 is an elevational perspective view of another embodiment of an elongated form sidewall of this invention.
Figure 8:
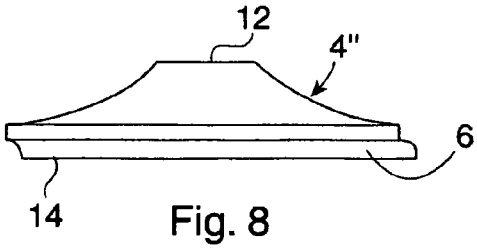
FIG. 8 is an elevational end view of the elongated form sidewall of FIG. 7.
Figure 9:
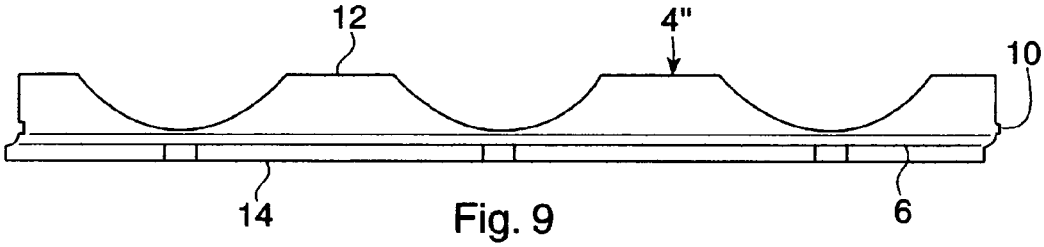
FIG. 9 is an elevational top view of the elongated form sidewall of FIG. 7.
Figure 10:
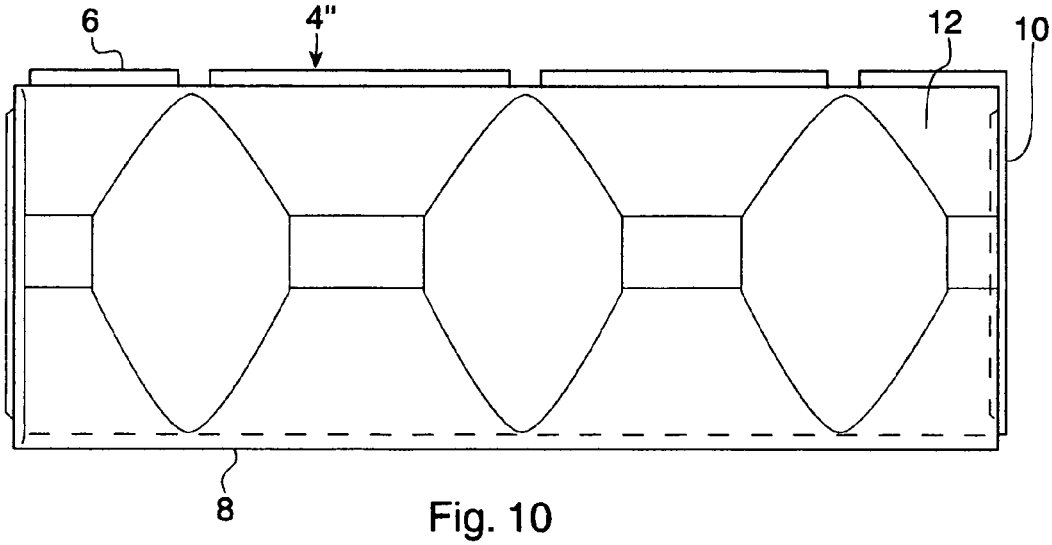
FIG. 10 is an elevational side view of the elongated form sidewall of FIG. 7.
Figure 11:
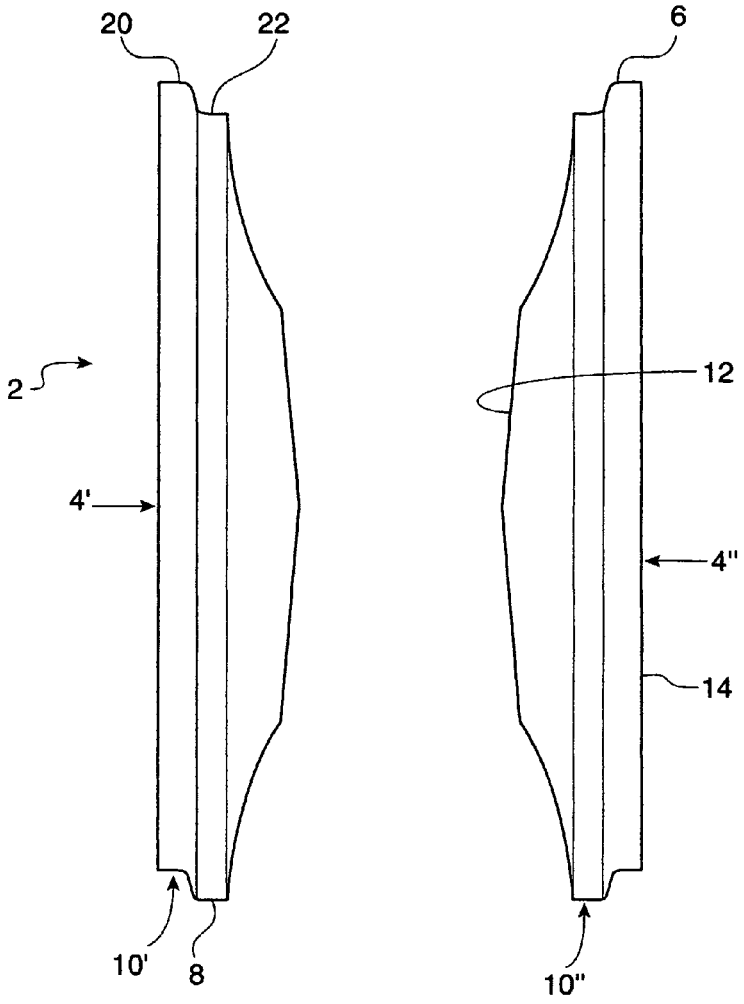
FIG. 11 is an elevational end view of an elongated form of this invention.
Figure 12:
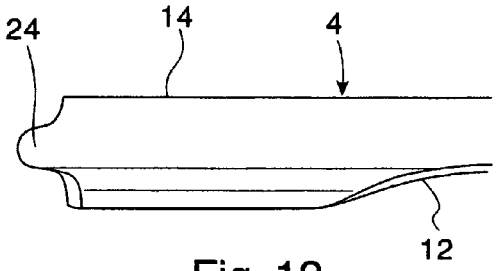
FIG. 12 is an elevational perspective view of a part of an elongated form sidewall showing a male connection.
Figure 13:
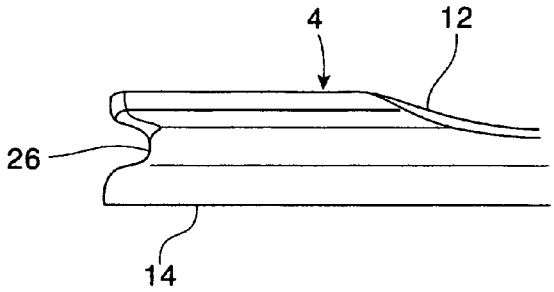
FIG. 13 is an elevational perspective view of a part of an elongated form sidewall showing a female connection.

As shown best in FIG. 11, each sidewall 4', 4" has a raised portion 20 and a non-raised portion 22 along the upper surface 6 which mate with a complementary non-raised portion 22 and raised 20 portion located along the lower surface 8 of an overlying form 2. In each sidewall 4' 4", the vertical surfaces 10', 10" as shown best in FIG. 2 are made up of a tongue 24 and groove 26. For a first (outer) sidewall 4', a first vertical surface 10' has a tongue 24 and the second vertical surface 10" has a corresponding groove 26. For the second (inner) sidewall 4" of a form 2, the sidewall 4" opposite the first sidewall 4', the first vertical surface 10' has a groove 26 and the second vertical surface 10" has a tongue 24 as best seen in FIGS. 12 and 13. Accordingly, the forms 2 may be connected in longitudinally extending courses and stacked one atop the other. In the above, "outer" and "inner" are related to the exterior or interior of the building. This is best shown in FIGS. 50 and 51.

Figure 50:
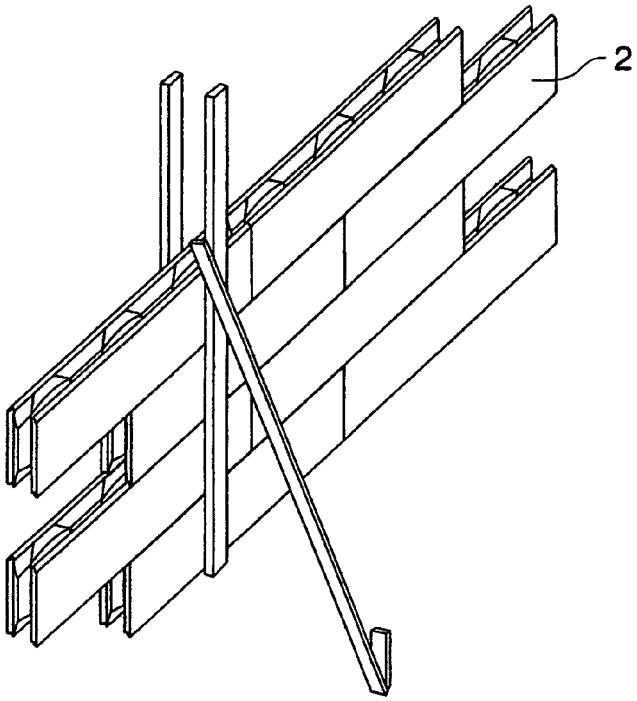
FIG. 50 is an elevational perspective view of a wall using the forms of this invention under construction.
Figure 51:
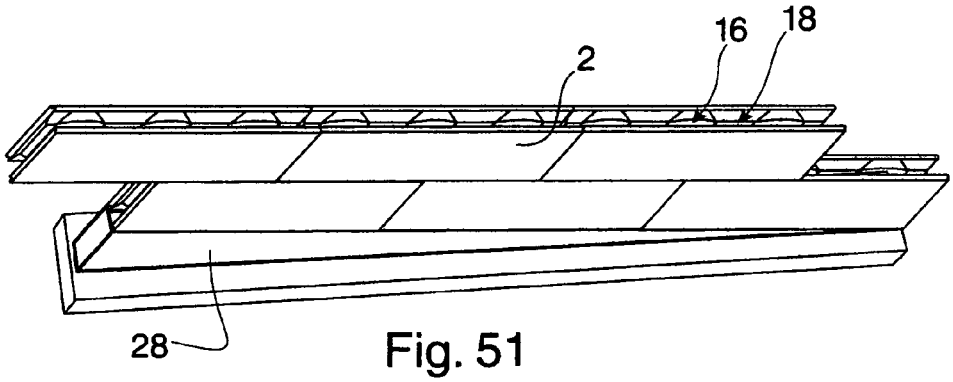
FIG. 51 is an elevational perspective view showing the placement of a bottom layer of forms in a wall.

Referring to FIGS. 50 and 51, the first course of longitudinal forms 2 is positioned atop a footing 28 and held in place by various materials such as plastic roof cement. It is understood that other types of connection of the first row of longitudinal forms 2 to the footing 28 may be utilized, such as placing the forms 2 in a wet footing 28 and allowing the footing 28 to subsequently dry. Upon reaching a desired height of the forms 2, wet concrete is poured between the form sidewalls 4. From FIG. 50, it is seen that the forms 2 are staggered among rows so as to preclude formation of a continuous vertical joint among the form rows. The poured concrete fills the vertical cavities 16 and longitudinally extending vertical slot 18 of each form 2. Also, upon stacking a second course of forms 2 atop the first course of forms 2, a horizontal channel is formed which spans the upper and lower forms 2. The poured concrete will fill the channel of the form 2. Thus, a concrete wall within the interior of the forms 2 is presented. The forms 2 are left in place for insulating the resulting concrete wall. Wall clips (not shown) may be used for attaching exterior siding thereto. Such clips are the subject of a separate patent application by the inventor.

It is known that the courses of the forms 2 may be selectively configured so as to present walls of various configurations. Also, door frames, window frames, bucks, bulkheads, and the like may interrupt the courses of forms 2 so as to provide openings for insertion of doors, windows and the like therein while precluding spillage of poured concrete from the forms 2.

Referring to FIGS. 15-42, corner forms 30 of this invention will be described. There is shown a universal corner form 30 for concrete walls. By universal corner form 30, it is intended to mean that there is an open left-hand side 32 of the corner form 30 or an open right-hand side 34 which can fit onto either end of the forms 2 of the present invention.

Figure 15:
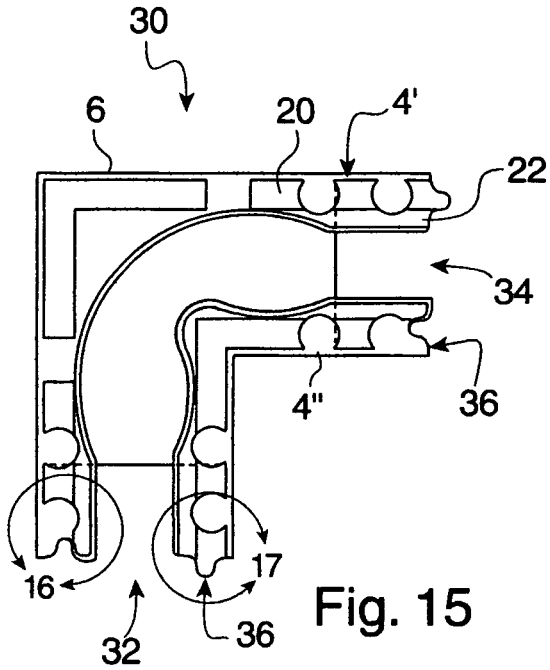
FIG. 15 is an elevational top view showing a corner form of this invention in place.
Figure 16:
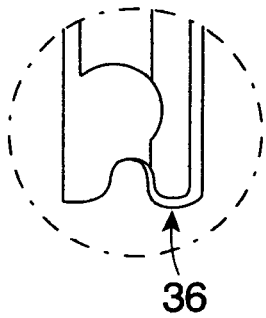
FIG. 16 is an enlarged elevational top view of a portion of a first sidewall shown in FIG. 15, showing the male connection in detail.
Figure 17:
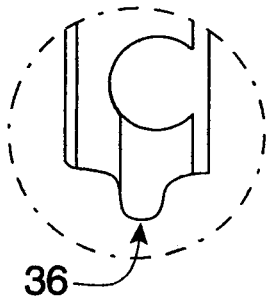
FIG. 17 is an enlarged elevational top view of a portion of a second sidewall shown in FIG. 15, showing the female connection in detail.
Figure 19:
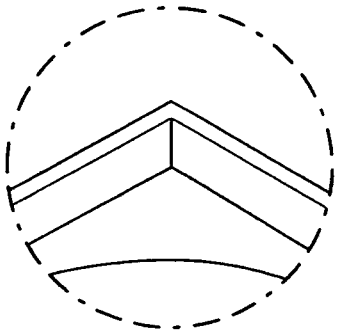
FIG. 19 is an enlarged detail view of the corner of the form of FIG. 18.
Figure 18:
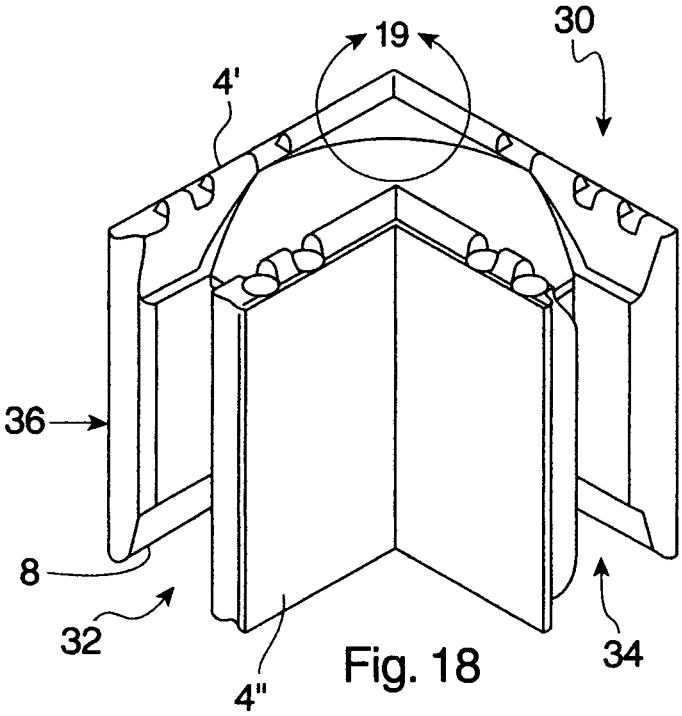
FIG. 18 is an elevational perspective view of a corner form of this invention.
Figure 23:
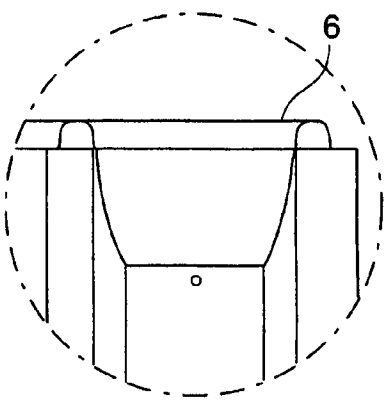
FIG. 23 is an enlarged detail view showing the top end of the form as seen in FIG. 22.
Figure 24:
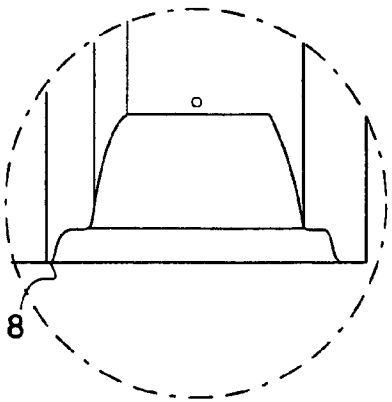
FIG. 24 is an enlarged detail view showing the bottom end of the form as seen in FIG. 22.
Figure 22:
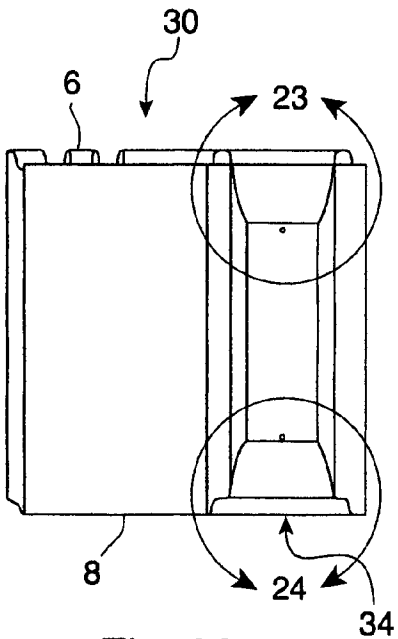
FIG. 22 is an elevational side view of the form of FIG. 15 from the right end of the form.
Figure 20:
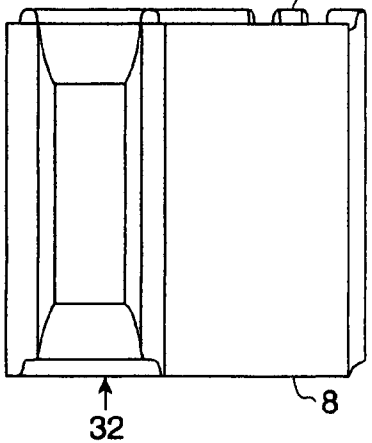
FIG. 20 is an elevational side view of the open side of the form of FIG. 15.
Figure 21:
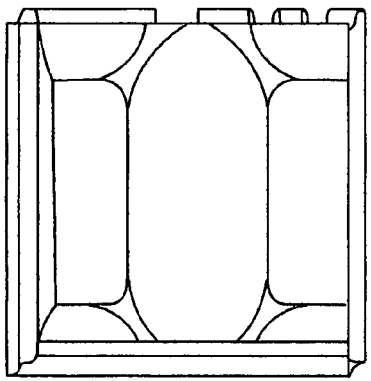
FIG. 21 is an elevational side view of the closed side of the form of FIG. 15.
Figure 25:
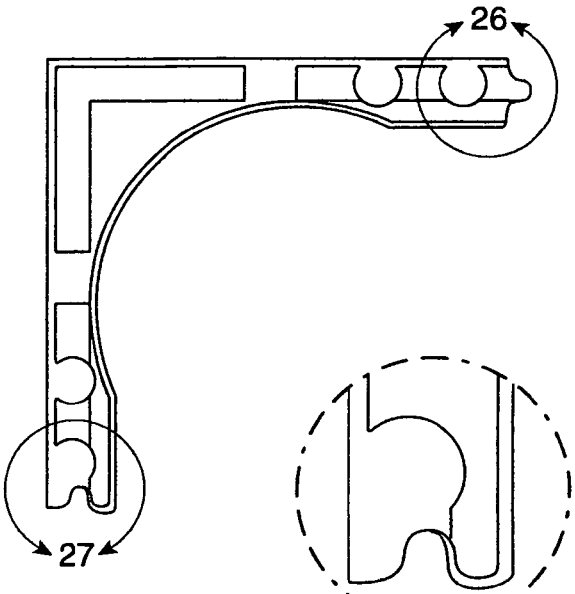
FIG. 25 is an elevational top view of a corner form sidewall of this invention.
Figure 26:
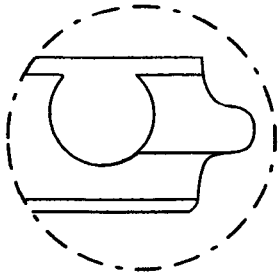
FIG. 26 is an enlarged elevational top view showing the male edge of the form sidewall of FIG. 25.
Figure 27:
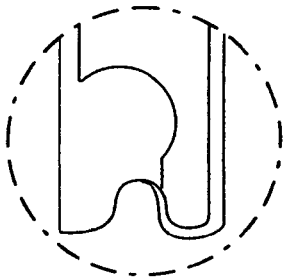
FIG. 27 is an enlarged elevational top view showing the female edge of the form sidewall of FIG. 25.
Figure 29:
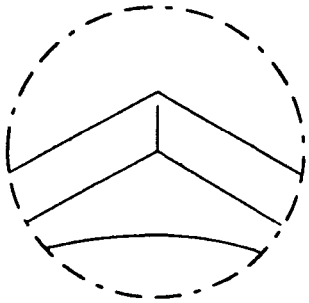
FIG. 29 is an enlarged elevational perspective view showing the top corner of the corner form sidewall of the present invention.
Figure 28:
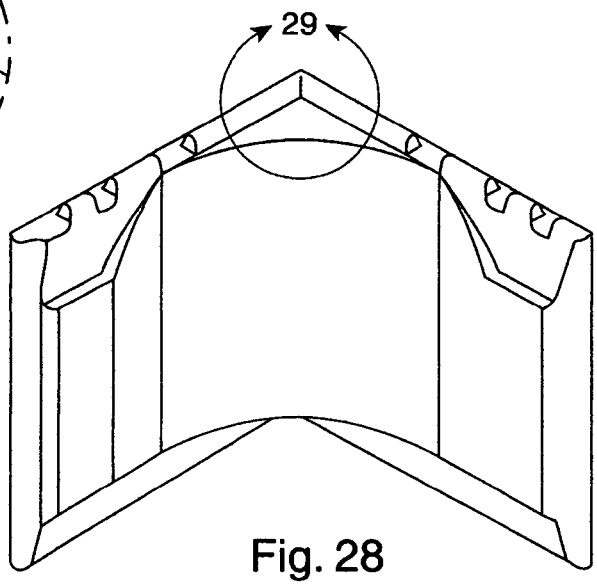
FIG. 28 is an elevational perspective view of a corner form sidewall of the present invention.
Figure 34:
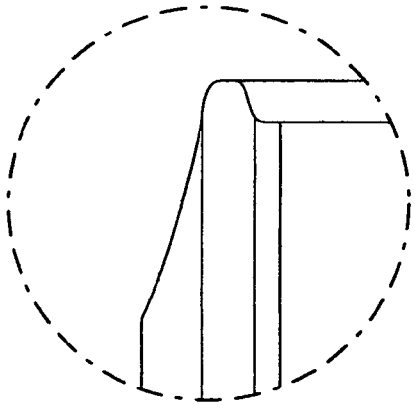
FIG. 34 is an enlarged elevational side view of the top end of the section of FIG. 33 showing detail.
Figure 33:
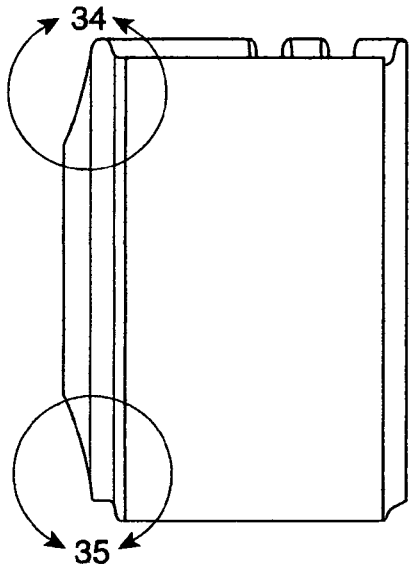
FIG. 33 is an elevational side view of a first corner sidewall section for a form of this invention.
Figure 35:
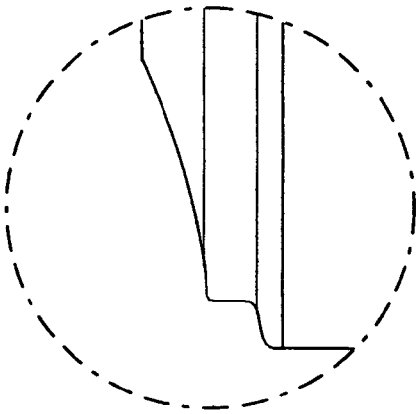
FIG. 35 is an enlarged elevational side view of the bottom end of the section of FIG. 33 showing detail.
Figure 37:
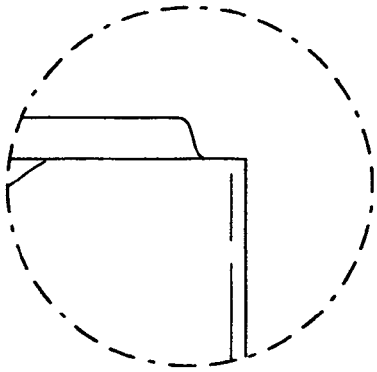
FIG. 37 is an enlarged elevational end view of the corner shown in FIG. 36 showing detail.
Figure 36:
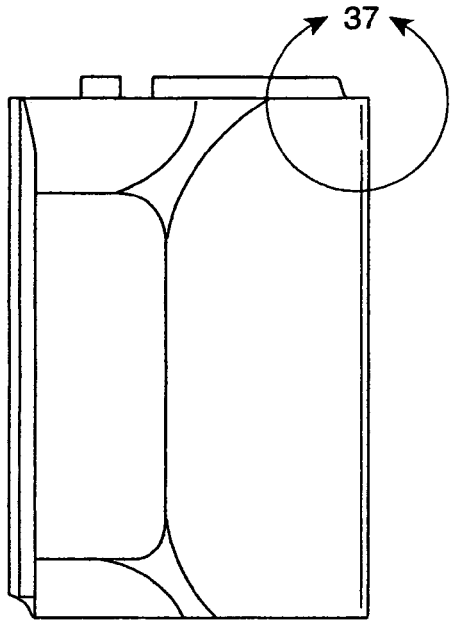
FIG. 36 is an elevational end view of a corner sidewall of this invention.
Figure 39:
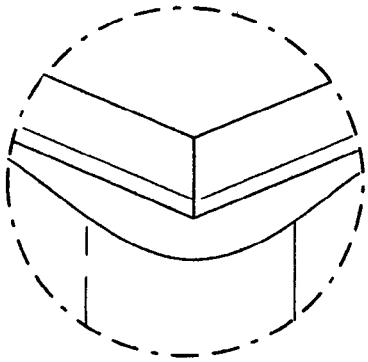
FIG. 39 is an elevational perspective view of a top corner section of a corner sidewall shown in FIG. 38 showing detail.
Figure 38:
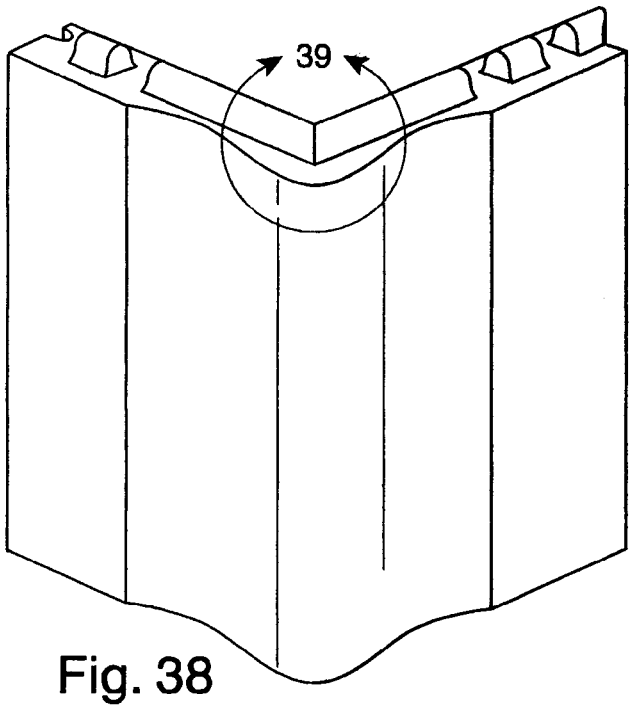
FIG. 38 is an elevational perspective view of a corner sidewall.
Figure 40:
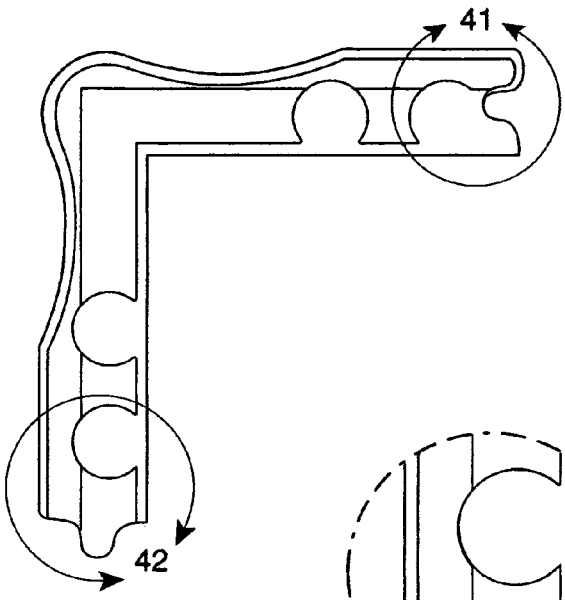
FIG. 40 is an elevational top view of a corner sidewall of this invention.
Figure 41:
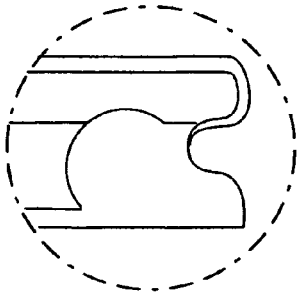
FIG. 41 is an elevational top view of a first end of the corner sidewall of FIG. 40 showing detail.
Figure 42:
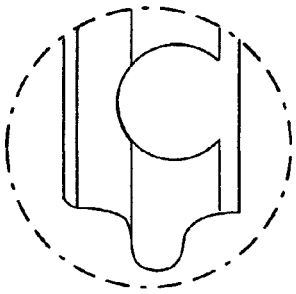
FIG. 42 is an elevational top view of a second end of the corner sidewall of FIG. 40 showing detail.
Figure 45:
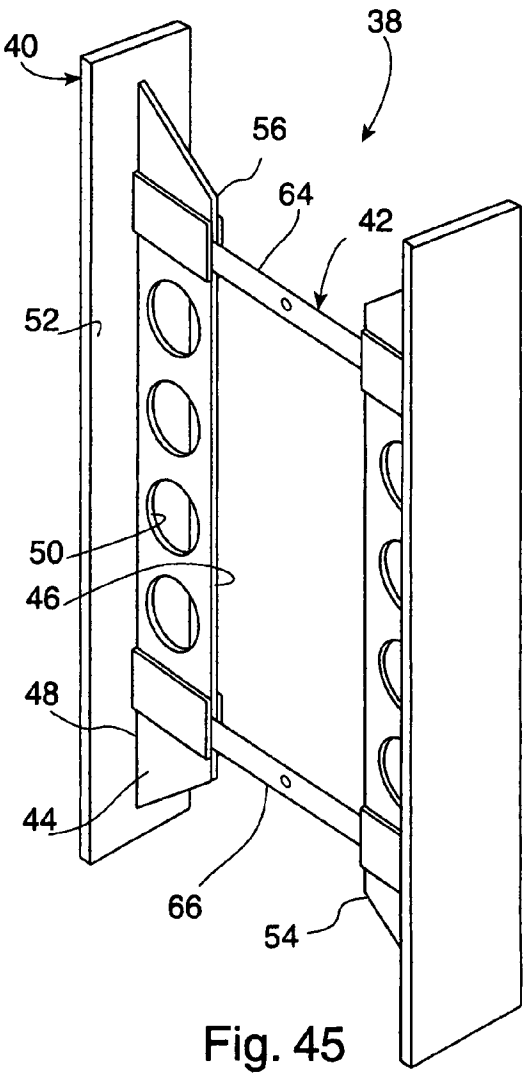
FIG. 45 is an elevational perspective view of a tie of the present invention.
Figure 44:
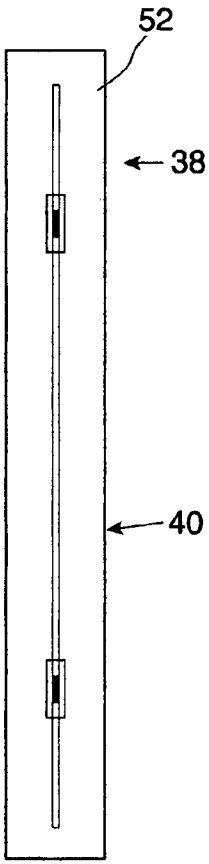
FIG. 44 is an elevational front view of a tie of the present invention
Figure 43:
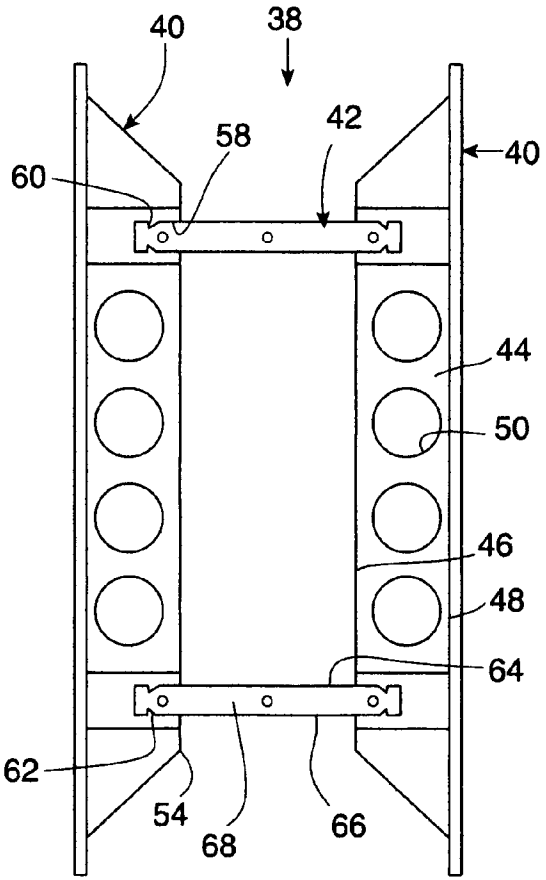
FIG. 43 is an elevational side view of a tie of the present invention
Figure 46:
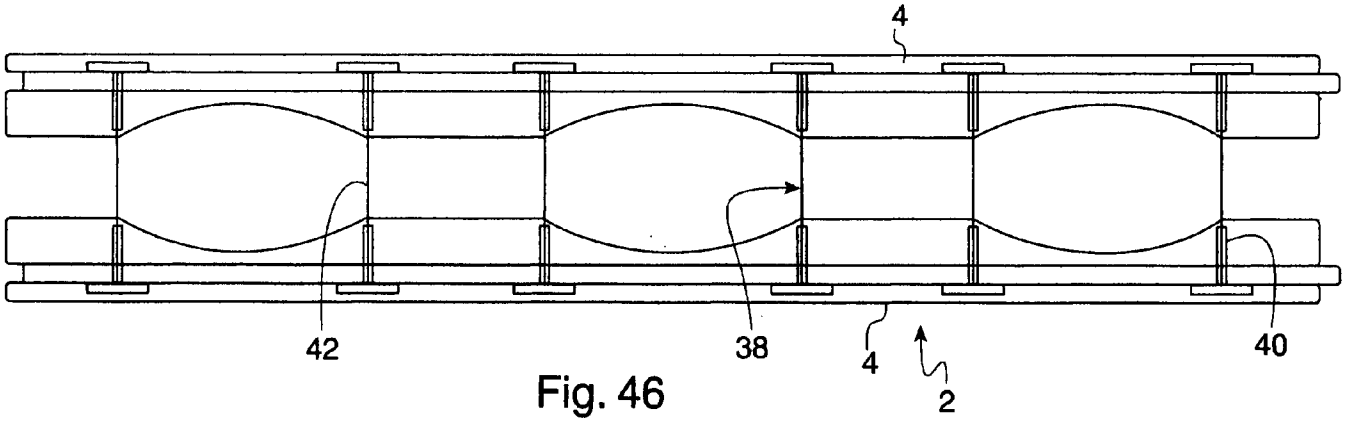
FIG. 46 is a top cross-sectional view of a form of one embodiment having ties attached thereto.
Figure 47:
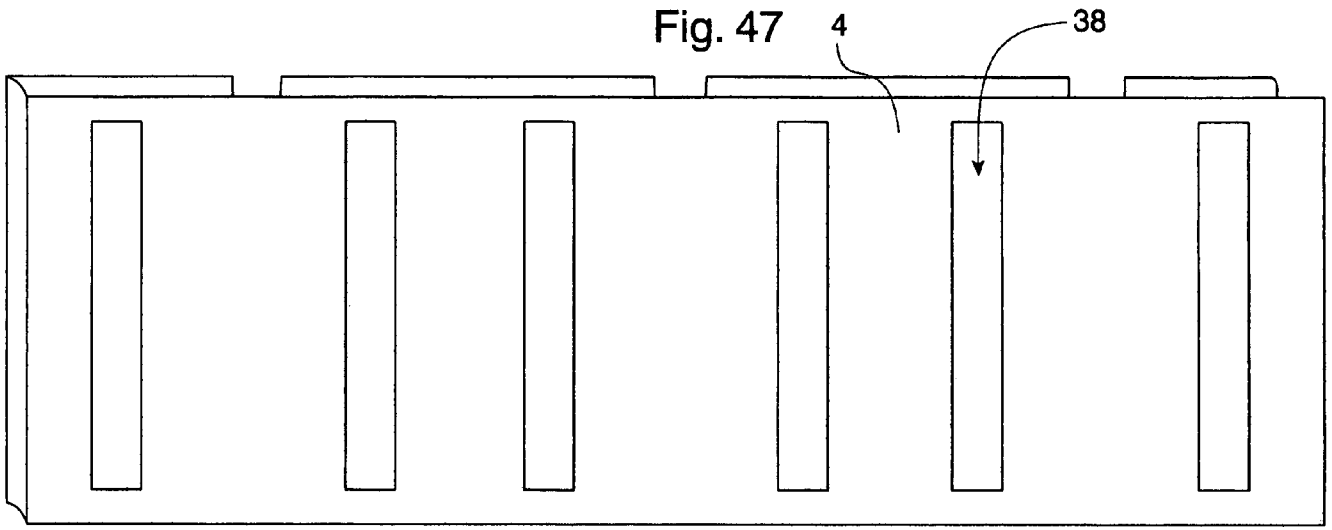
FIG. 47 is a front cross-sectional view of a form of one embodiment having ties attached thereto.
Figure 49:
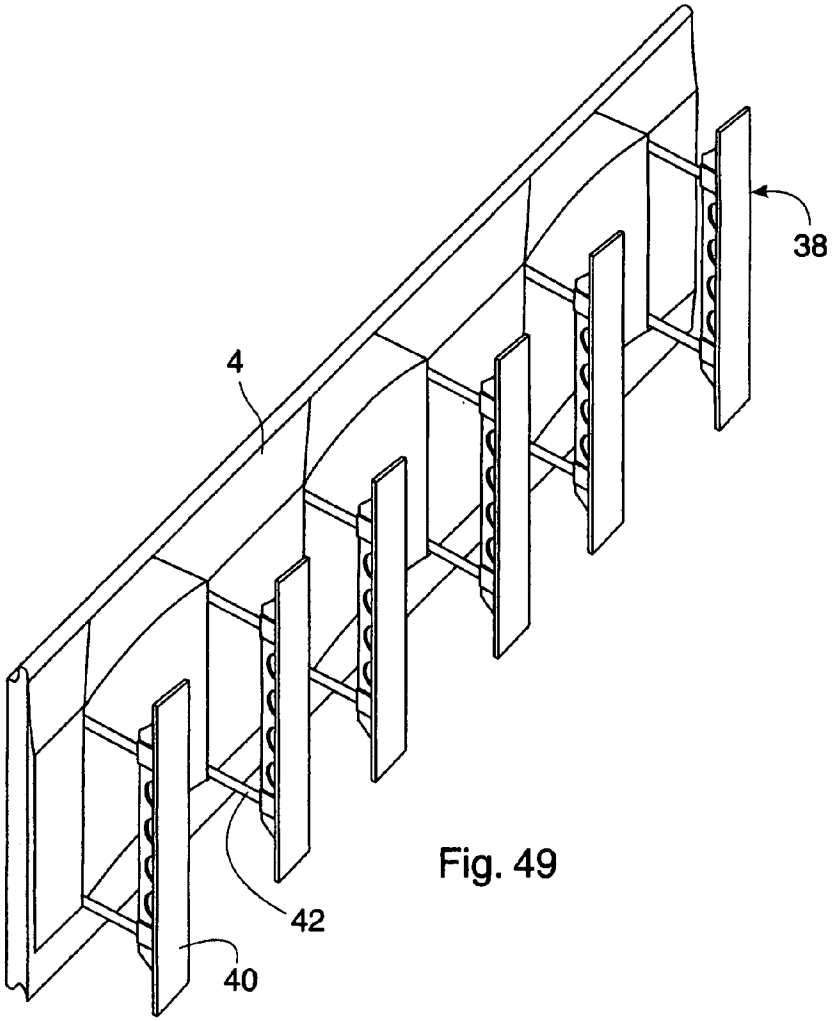
FIG. 49 is an elevational perspective view of a sidewall of one embodiment of this invention having ties attached thereto.
Figure 48:
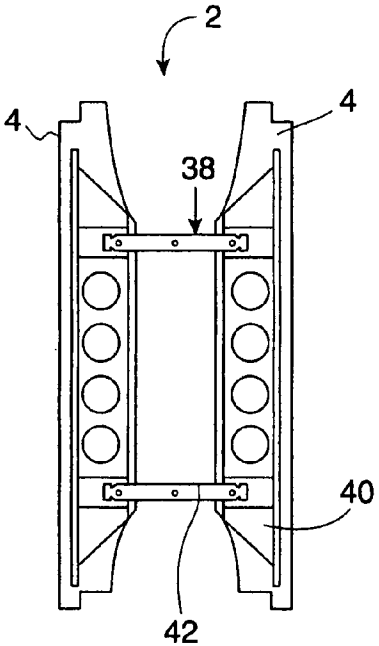
FIG. 48 is an end cross-sectional view of a pair of concrete form sidewalls of this invention having ties attached thereto.

As can best be seen in FIGS. 15-17, the vertical surfaces 36 of the corner form 30 are the same as the vertical surfaces 10 of the sidewall forms 2. Also, the upper 6 and lower 8 longitudinal surfaces of the corner pieces 30 are configured identically to the upper 6 and lower 8 surfaces of the sidewall forms 2.

Figure 14:
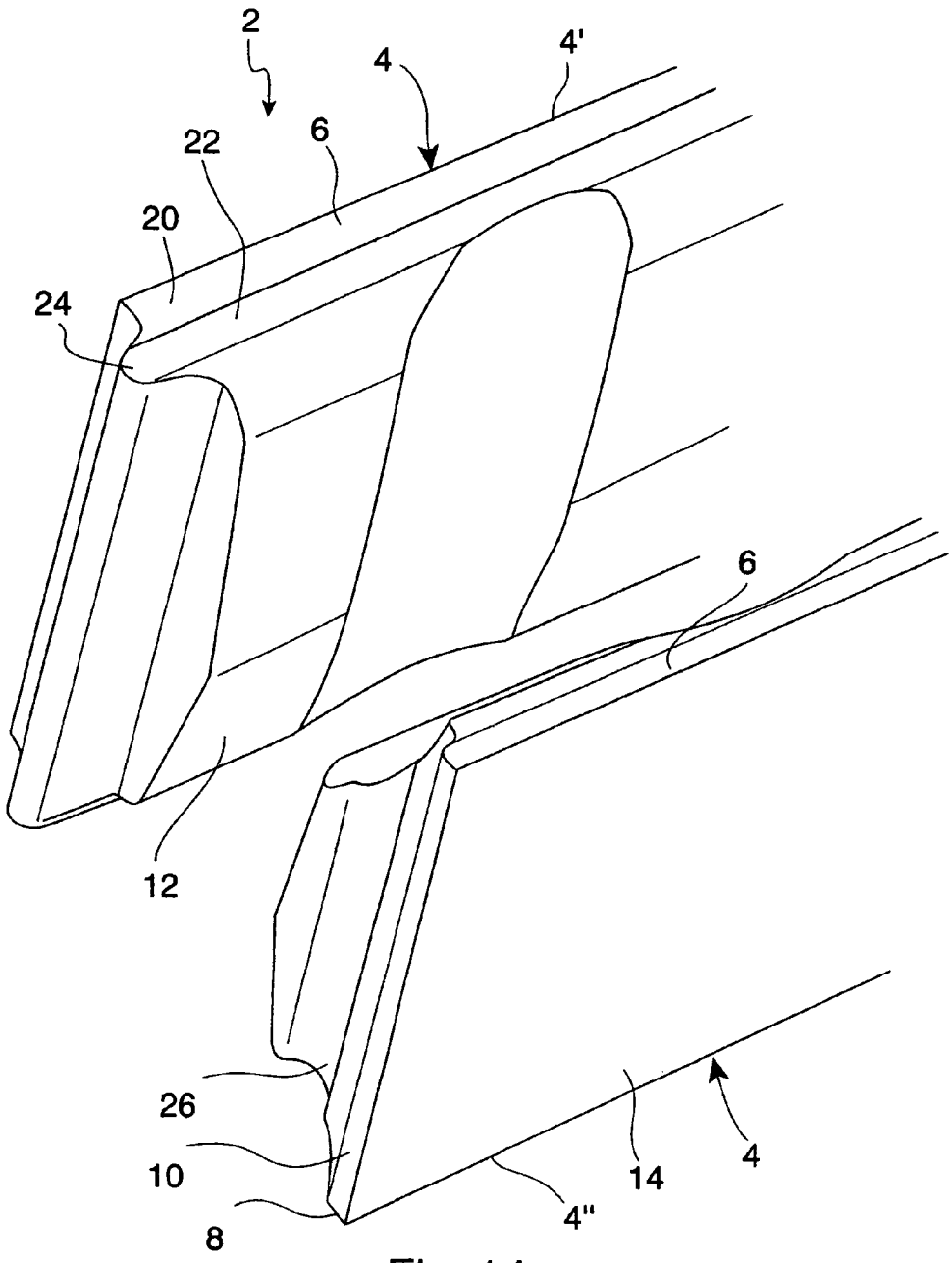
FIG. 14 is an elevational perspective view of an elongated form of the present invention showing the contours of the form.

With reference to the sidewall form 2 shown in FIG. 14, it may be assumed that the sidewall 4 which has the tongue 24 on the vertical surface 10 is the outer sidewall 4' while the sidewall 4 which has the groove 26 on the vertical surface 10 is the inner sidewall 4".

In order to make a left corner using the above form, the open right-hand side 34 of the corner form 30 as shown in FIG. 15 is connected to the above form 2. Similar straight forms 2 may then be connected to the open left-hand side 32 of the corner form 30. In such an arrangement, the upper longitudinal surface 6 of both the straight forms 2 and the corner forms 30 will contain raised portions 20 along the outer surface 14 and non-raised portions 22 along the inner surfaces 12.

In a like manner, to form a right corner using the above corner form 30, the open left-hand side 32 of the corner form 30 shown in FIG. 15 is connected to the above straight form 2. Again, straight forms 2 may be connected to the free end of the corner form 30. In such an arrangement, the upper longitudinal surface 6 of both the sidewalls 4 and the corner pieces will contain raised portions 20 along the outer surface 14 and non-raised portions 22 along the inner surfaces 12.

Should the straight form 2 be in place such that the outer sidewall 4' contains an upper longitudinal surface 6 having a raised portion 20 along inner surface 12 and a non-raised portion 22 along the outer surface 14, the corner form 30 may simply be turned over so that the former upper longitudinal surface 6 is now the lower longitudinal surface 8. The corner form 30 will then have an outer sidewall 4' which contains an upper longitudinal surface 6 having a raised portion 20 along inner surface 12 and a non-raised portion 22 along the outer surface 14. This allows the corner form 30 of the present invention to be a universal corner form as it can form a left corner or right corner regardless of the configuration of the vertical surfaces of the sidewalls 4 of the form 2.

Referring to FIGS. 43-49, the ties 38 of this invention are described. Each tie 38 presents an overall square or rectangular configuration. The tie 38 comprises first and second laterally spaced-apart vertical thermoplastic side pieces 40 with two connecting metal horizontal pieces 42 therebetween.

Each side piece 40 generally comprises a vertical holder 44 having a proximal edge 46 and a distal edge 48. The proximal edge 46 is of lesser length than the distal edge 48. The vertical holder 44 contains a plurality of holes 50 to allow the passage of polystyrene beads and to avoid the buildup of air pockets in the vicinity of the tie 38. The side piece 40 contains a vertical flange 52 laterally displaced from each side of the proximal edge 46 of the vertical holder 44. The presence of two flanges 52 gives added dimensional stability and strength to the prepared form 2.

A horizontal piece 42 in the form of a thin metal band extends between approximately the midline between the proximal edge 46 and the distal edge 48 of a first vertical holder 44 and approximately the corresponding midline of a second vertical holder 44 at the lower ends 54 thereof. Likewise, upper ends 56 of first and second vertical holders 44 are similarly joined by a metal horizontal piece 42. The horizontal pieces 42 may be secured to the vertical holders 44 by common fastening devices, preferably rivets. Dimensional stability may be assured by having the horizontal pieces 42 fit into grooves 58 in the vertical holders 44. Complimentary notches 60 and protrusions 62 in the horizontal pieces 42 and the vertical holders 44 serve to increase lateral and vertical dimensional stability of the tie 38 and any form 2 containing the tie 38. The thin metal band horizontal piece 42 is located such that the upper 64 and lower surfaces 66 are narrow and the two side surfaces 68 are wide.

In the event of a fire on a first side of a concrete wall prepared using the ties 38 and forms 2 of the present invention, the thermoplastic side pieces 40 melt and cannot transfer sufficient heat to the metal horizontal pieces 42 to allow the fire to spread to the opposite side of the concrete wall.

As is known in the prior art, two bipartite molds are used for forming the sidewalls of the polymeric concrete form. Polystyrene beads are blown into the respective sidewall molds at a first temperature with the beads expanding upon cooling so as to fill the mold. Upon the beads being reheated at an elevated temperature, a second expansion occurs so that the foam fills the mold. Upon removal of the mold the sidewalls 4 are presented.

One problem which has arisen with the use of form ties is that the sidewall molds must have openings therein to allow for insertion of the ends of the tie in each mold and extension of the tie between the sidewall molds. In turn, the expanding foam may escape from these mold openings. Such a leakage/seepage of the foam from the mold may impair form integrity and lead to undesirable ruptures, cracks, etc. in the forms. Such defects may not be visibly apparent until the form sidewalls are subjected to the hydraulic loads presented by the poured concrete between the form sidewalls.

In response to such a problem, the vertical side pieces 40 of the ties 38 of this invention are configured to seal the mold openings. The forms 2 are prepared as a unit with the ties 38 being embedded in the sidewalls 4. Thus, the vertical side pieces 40 preclude escape of the expanding polystyrene foam from the mold. Also, the distance between these vertical side pieces 40 defines the length of the horizontal pieces 42 and thus the resulting lateral displacement between the sidewalls 4. Accordingly, the coplanar relationship of the opposed, interior surfaces 12 of the sidewalls 4 presents a visual gauge of a common lateral displacement between the sidewalls 4 of the forms 2.

Thus, the horizontal pieces 42 fix and maintain a desired lateral distance between the interior surfaces 12 of the sidewalls 4 of the form 2. This common lateral modularity assures the builder that the stacked forms will present even exterior surfaces As best shown in FIGS. 46-49, the ties 38 are embedded in the sidewalls 4 of the form 2. As such, they resist any forces acting thereon which may disrupt the monolithic structure of the sidewall 4. The horizontal pieces 42 span the sidewalls 4. As such, a plurality of horizontal pieces extends between the sidewalls 4 so as to maintain the distance therebetween in the presence of hydraulic concrete loads. It is noted that the horizontal pieces 42 are so arranged as to present a minimal amount of surface to a longitudinal concrete flow through the form 2.

The ties 38, as above described, resist tension, compression, bending, twisting and lateral forces acting thereon during transport as well as during concrete pouring and curing.

Thus, longitudinal shifting of the sidewalls 4 of the form 2 is particularly precluded. Such preclusion also contributes to the elimination or reduction in the width modularity during form use.

Figure 52:
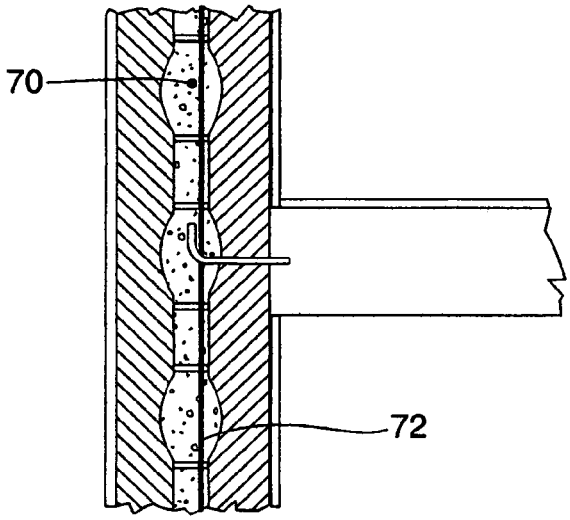
FIGS. 52 and 53 are cross-sectional views of the forms of this invention having rebars passing through poured concrete and inner and outer finishing.
Figure 53:
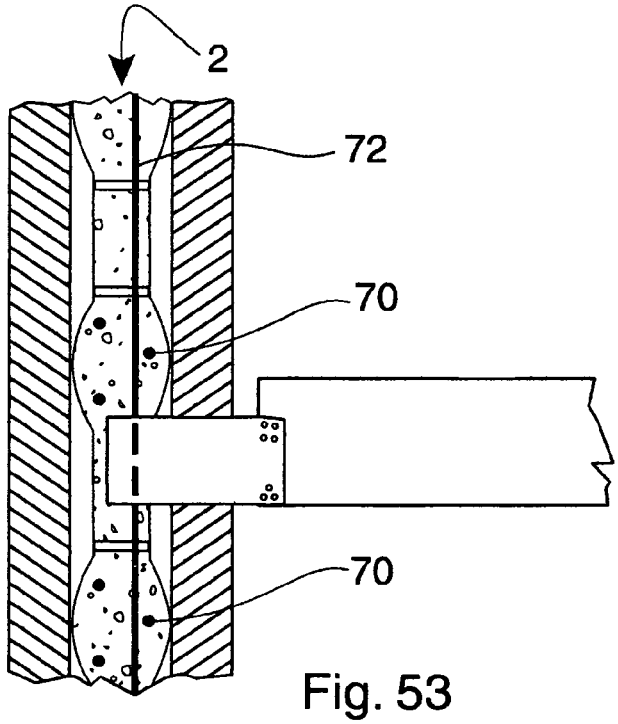

Referring to FIGS. 52 and 53, following construction of the form wall and prior to the pouring of the concrete, horizontal rebars 70 are placed on the upper surface 64 of one lower horizontal piece 42 and the corresponding surface 64 of the other lower horizontal pieces 42 of the ties 38. Following the installation of horizontal rebars 70, vertical rebars 72 are installed offset from the center of the form 2 to lend support to the concrete wall. Following the installation of vertical rebars 72, the vertical 72 and horizontal 70 rebars are tied into place.

As best seen in FIGS. 3-10, some of the inner sidewalls 4" contain notches 96 on the upper longitudinal surface 6 thereof. These notches 96 may hold the short side of L-shaped pieces (not shown). The long side of such pieces will fit against the outer surface 14 of the sidewalls 4. The configuration of the short side of the L-shaped piece is such that it completely fills the notch 96. The configuration of the long side of the L-shaped piece is such that it will lie flat along the outer surface 14 of the inner sidewall 4". The long side presents a solid surface to aid in nailing studs to the inner sidewall 4". To this end, the distance between the notches 96 is equal to the conventional distance between studs.

It is to be understood that while certain forms of this invention and dimensions have been illustrated and described, the invention is not limited thereto except insofar as such limitations are included in the following claims and allowable functional equivalents thereof.

The invention claimed is:

1. An insulating sidewall form for concrete, which form is stackable horizontally and vertically above and below with other like forms, comprising two rectangular foam plastic sidewalls making up an inner sidewall and an outer sidewall the inner and outer sidewalls each having:

an interior surface, such that when the two sidewalls are positioned to create the form, the interior surfaces of the sidewalls form a plurality of vertical cavities and vertical slots, a flat exterior surface, the inner sidewall further having:

a first horizontal surface having a raised portion along the interior surface and a non-raised portion along the exterior surface, a second horizontal surface having a non-raised portion along the interior surface and a raised portion along the exterior surface, and opposed vertical surfaces, a first vertical surface having a tongue and a second vertical surface having a complimentary groove, the outer sidewall further having:

a first horizontal surface having a non-raised portion along the interior surface and a raised portion along the exterior surface, a second horizontal surface having a raised portion along the interior surface and a non-raised portion along the exterior surface, the raised and non-raised portions being arranged so as to allow attachment of the upper surfaces of one form with the lower surfaces of like forms, and opposed vertical surfaces, a first vertical surface having a tongue and a second vertical surface having a complimentary groove, the tongues and grooves of the form being so arranged that each end of the form will contain one tongue and one groove so as to allow end-to-end attachment of like forms, the form containing a plurality of ties connecting the sidewalls and maintaining the sidewalls at a constant distance from each other.

2. An insulating corner form for concrete, which form is stackable vertically above and below with other like forms and is attachable to sidewall forms, the corner form comprising two angled corner walls making up an inner corner wall and an outer corner wall, each wall having an interior surface and a flat exterior surface, such that when the two corner walls are positioned to create the form, the interior surfaces of the corner walls form a plurality of vertical cavities and vertical slots, the inner corner wall having:

a first horizontal surface having a raised portion along the interior surface and a non-raised portion along the exterior surface, a second horizontal surface having a non-raised portion along the interior surface and a raised portion along the exterior surface, and opposed vertical surfaces, a first vertical surface having a tongue and a second vertical surface having a complimentary groove, the outer corner wall having:

a first horizontal surface having a non-raised portion along the interior surface and a raised portion along the exterior surface, a second horizontal surface having a raised portion along the interior surface and a non-raised portion along the exterior surface, the raised and non-raised portions being arranged so as to allow attachment of the upper surfaces of one form with the lower surfaces of like forms, and opposed vertical surfaces, a first vertical surface having a tongue and a second vertical surface having a complimentary groove, the tongues and grooves of the corner form being so arranged that each end of the corner form will contain one tongue and one groove so as to allow end-to-end attachment of like corner forms and like sidewall forms and will further allow the same corner form to be used as a left corner or a right corner, and the form containing a plurality of ties connecting the corner walls and maintaining the corner walls at a constant distance from each other.

3. The insulating corner form of claim 2, wherein the angle is a right angle.

4. A combination comprising:

an insulating sidewall form for concrete, which form is stackable horizontally and vertically above and below with other like forms, comprising two rectangular foam plastic sidewalls making up an inner sidewall and an outer sidewall, each sidewall having an interior surface and a flat exterior surface such that when the two sidewalls are positioned to create the form, the interior surfaces of the sidewalls form a plurality of vertical cavities and vertical slots, and the inner sidewall further having:

a first horizontal surface having a raised portion along the interior surface and a non-raised portion along the exterior surface, a second horizontal surface having a non-raised portion along the interior surface and a raised portion along the exterior surface, and opposed vertical surfaces, a first vertical surface having a tongue and a second vertical surface having a complimentary groove, the outer sidewall having:

a first horizontal surface having a non-raised portion along the interior surface and a raised portion along the exterior surface, a second horizontal surface having a raised portion along the interior surface and a non-raised portion along the exterior surface, the raised and non-raised portions being arranged so as to allow attachment of the upper surfaces of one form with the lower surfaces of like forms, and opposed vertical surfaces, a first vertical surface having a tongue and a second vertical surface having a complimentary groove, the tongues and grooves of the form being so arranged that each end of the form will contain one tongue and one groove so as to allow end-to-end attachment of like forms, the form containing a plurality of ties connecting the sidewalls and maintaining the sidewalls at a constant distance from each other, and an insulating angled corner form for concrete, which form is stackable vertically above and below with other like forms and is attachable to sidewall forms, the corner form comprising an inner corner wall and an outer corner wall, the inner and outer corner walls each having:

an interior surface, such that when the two corner walls are positioned to create the form, the interior surfaces of the corner walls form a plurality of vertical cavities and vertical slots, and a flat exterior surface, the inner corner wall having:

a first horizontal surface having a raised portion along the interior surface and a non-raised portion along the exterior surface, a second horizontal surface having a non-raised portion along the interior surface and a raised portion along the exterior surface, and opposed vertical surfaces, a first vertical surface having a tongue and a second vertical surface having a complimentary groove, the outer corner wall having:

a first horizontal surface having a non-raised portion along the interior surface and a raised portion along the exterior surface, a second horizontal surface having a raised portion along the interior surface and a non-raised portion along the exterior surface, the raised and non-raised portions being arranged so as to allow attachment of the upper surfaces of one form with the lower surfaces of like forms, and opposed vertical surfaces, a first vertical surface having a tongue and a second vertical surface having a complimentary groove, the tongues and grooves of the corner form being so arranged that each end of the corner form will contain one tongue and one groove so as to allow end-to-end attachment of like corner forms and like sidewall forms and will further allow the same corner form to be used as a left corner form or a right corner form, the form containing a plurality of ties connecting the corner walls and maintaining the corner walls at a constant distance from each other.

5. The combination of claim 4, wherein the angle of the corner form is a right angle.

* * * * *